United States Patent [19]

Gugger et al.

[11] 4,054,270

[45] Oct. 18, 1977

[54] MICRO MIXING APPARATUS AND METHOD

[75] Inventors: Robert E. Gugger, Willow Grove; Samuel M. Mozersky, Elkins Park, both of Pa.

[73] Assignee: The United States of America as represented by the Secretary of Agriculture, Washington, D.C.

[21] Appl. No.: 671,752

[22] Filed: Mar. 30, 1976

Related U.S. Application Data

[63] Continuation-in-part of Ser. No. 481,414, June 20, 1974, abandoned.

[51] Int. Cl.[2] ..... B01F 13/08

[52] U.S. Cl. ..... 366/143; 366/177; 366/273

[58] Field of Search ..... 242/5, 1 R, 7, 9, 15, 242/DIG. 46

[56] References Cited

U.S. PATENT DOCUMENTS

| | | | |
|---|---|---|---|
| 3,245,665 | 4/1966 | Steel | 259/DIG. 46 |
| 3,689,033 | 9/1972 | Holmstrom | 259/5 |
| 3,749,369 | 7/1973 | Londsberger | 259/DIG. 46 |
| 3,784,170 | 1/1974 | Petersen | 259/DIG. 46 |
| 3,907,258 | 9/1975 | Spozioni | 259/4 |

*Primary Examiner*—Edward J. McCarthy
*Attorney, Agent, or Firm*—M. Howard Silverstein; William E. Scott; David G. McConnell

[57] ABSTRACT

An apparatus having a tubular shaped mixing chamber in which is enclosed a coated bar magnet for thoroughly mixing multiple streams of continuously flowing individual solutions. Movement of the coated bar magnet is restricted to yawing, pitching, and rolling by designed space limitations. The bar magnet is activated by placing the chamber over or in close proximity to a magnetic stirrer.

14 Claims, 2 Drawing Figures

Fig. 1
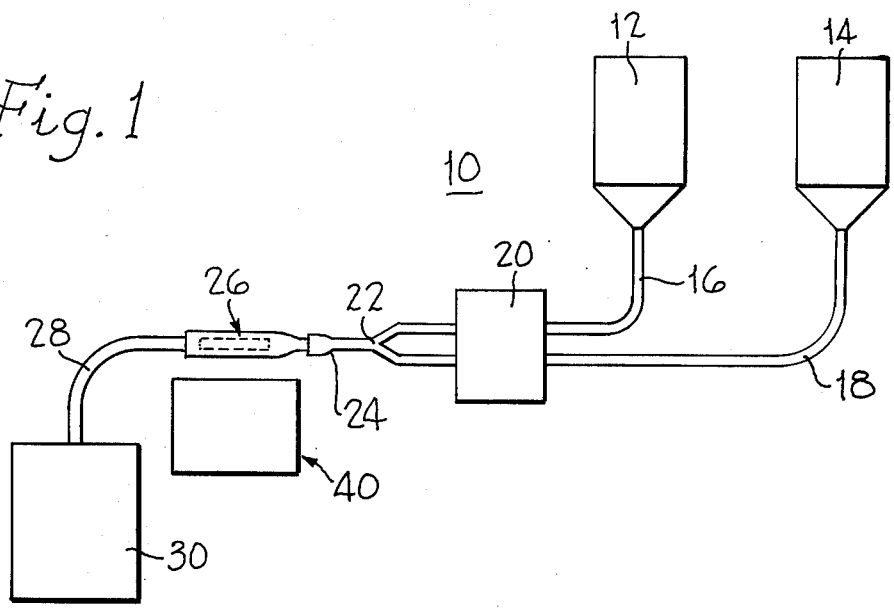
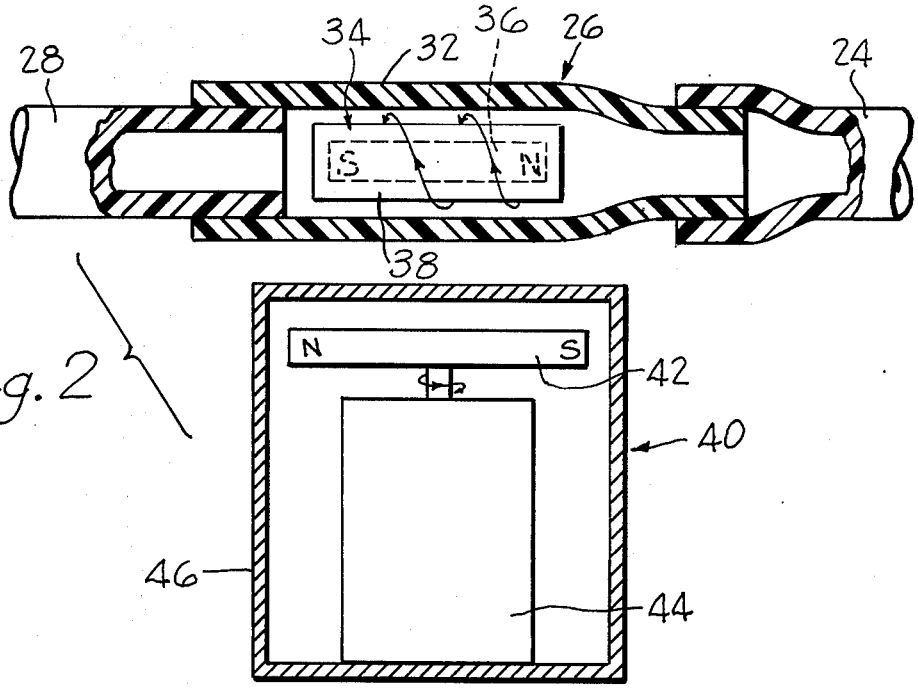
Fig. 2

MICRO MIXING APPARATUS AND METHOD

This application is a continuation in part of application Ser. No. 481,414; filed June 20, 1974, abandoned.

This invention relates to an apparatus for thoroughly mixing two or more streams of solution and more particularly to an apparatus for thoroughly mixing two or more low velocity streams of solution subsequent to their point of confluence.

Mixing devices are not unknown in the prior art. For example, in U.S. Pat. No. 3,689,033, Holstrum et al disclose a transversally magnetized stirring rod enclosed in a mixing chamber which is secured between two pole pieces attached to a magnetic core provided with two coils connected to an alternating voltage source. By means of the alternating voltage source and the coils an alternating magnetic field is provided within the mixing chambers which causes the transversally magnetized stirring rod to rotate around an axis parallel to the longitudinal axis of the mixing chamber. In response to the driving magnetic force field the north and south poles of Holstrum et als' driven rod continually interchange positions in a cyclical fashion. Petersen et al, U.S. Pat. No. 3,784,170, disclose a longitudinally magnetized driven stirrer or stirring element positioned inside a sample cell in conjunction with a rotatable drive magnet positioned outside the cell. The stirring element is positioned in the cell with its magnetic axis parallel to the sidewalls of the cell. The drive magnet rotates the stirring element about an axis perpendicular to the sidewalls so that the plane of rotation of the stirring element is the same as that of the drive magnet, that is, parallel to the sidewalls of the cell. As in Holstrum et al, the north and south poles of Petersen et als' driven magnetic stirring element continually interchange positions in a cyclical fashion. French Pat. No. 1,271,238 to Technicon and French Pat. No. 991,941 to Wagner both disclose mixing devices in which a driven magnetic bar rotates in the same direction as the driving magnet, that is, end over end rotation around an axis vertical to both the driving and the driven magnet. In both of the French patents as is Holstrum et al and in Petersen et al, the north and south poles of the driven magnetic stirring bars or elements continually interchange positions in a cyclical fashion.

Thorough mixing of two or more streams of solution is important in many kinetic measurements and in continuous assay procedures. Such mixing is easily accomplished with high velocity streams, that is, those having velocities of 100 cm./sec. or more, where turbulence is readily achieved. However, with presently available devices, we found that thorough mixing is not readily achieved when the streams have a low velocity.

It is, therefore, an object of this invention to provide an apparatus which will thoroughly mix the continuously flowing confluent fluid from multiple low velocity streams of individual solutions.

A further object of this invention is to provide a device in which the mixing action for low velocity streams is easily controlled.

According to this invention, the above objects are accomplished by an apparatus having, subsequent to the point of confluence of the flowing streams, a generally tubular shaped device comprised of a mixing chamber, a movable means within said mixing chamber for agitating and mixing fluids, the longitudinal axis of the movable means being generally aligned with that of the mixing chamber when the movable means is not in motion, and means for activating said movable means and causing it to yaw, pitch, and roll. The fluids to be mixed flow to a point of confluence through suitable tubes or other means of transport from individual reservoirs or other sources of flowing fluids, as for example, chromatographic columns. The flow rate of each of the fluids can be controlled by placing a device for this purpose between the reservoir and the point of confluence. Although many wellknown devices can be used, a peristaltic pump was found to be suitable and convenient for the purposes of this invention. The mixing chamber is comprised of a tubular shaped body, constricted at one end and having inlet and outlet ports. Enclosed within the chamber is a tetrafluoroethylene fluorocarbon resin (Teflon) coated bar magnet. This particular coating is not a critical element. The only restriction necessary with regard to the coating is that it be inert to the fluids and solvents used in the system. The coated bar magnet, whose longitudinal axis is in general alignment with that of the tubular shaped chamber, is restricted in longitudinal movement to a section of the chamber measuring about 1.5 times the length of the coated bar magnet. Movement of the coated bar magnet is further restricted because the internal diameter of the tubular chamber is less than the length of the bar. In operation the coated bar magnet is activated by placing the mixing chamber on or in close proximity to a magnetic stirrer. The action of the rotating driving magnet in the stirrer and the consequent alternately matching and opposing polarities of the two magnets, in addition to the restricted space in which the magnet is confined, cause the coated bar magnet in the mixing chamber to yaw, pitch, and roll. The space restrictions or limitations, both longitudinal and diametrical, on the magnet prevent it from assuming the usual motion of a stirring bar, that is, end-over-end rotation about a vertical axis. Consequently, in sharp contrast to the prior art devices and the principles which govern their operation, the north and south poles of the driven bar magnet of our invention never interchange positions. Mixing action is easily controlled by adjusting the rate of rotation of the driving magnet in the magnetic stirrer. The mixed fluid is then conveyed to a reservoir or point of observation by any suitable means. The efficiency of mixing the confluent fluids at different flow rates with the device of this invention was found to far exceed the efficiency of mixing without the device. The efficiency of mixing in the presence of the device of this invention was better than 99.5% at flow rates ranging from 0.02 cm./sec. to 1.31 cm./sec. while the efficiency of mixing without the device ranged from 35% at a 0.02 cm./sec. flow rate to 4.0% at a 1.31 cm./sec. flow rate.

Other objects, features, and advantages of the present invention will become more apparent from the following description in conjunction with the drawings, in which:

FIG. 1 is a diagrammatic view of the general arrangement of the micro mixing apparatus; and FIG. 2 is a cross sectional view illustrating the mechanism of the mixing device.

As shown in FIG. 1, the apparatus is comprised of a general assembly, 10, having reservoirs or sources of flowing fluid, two of which, 12 and 14, are illustrated, suitable tubes, 16 and 18, or other means of transporting the fluid from the reservoirs to the peristaltic pump 20, a point of confluence 22 where the fluids enter common fluid carrier 24 which transports them to mixing chamber 26. The mixed fluid is conducted from mixing chamber 26 through tube 28 to reservoir or point of observation 30. An enlarged, cross sectional view of chamber 26 is shown in FIG. 2. Chamber 26 has an enlarged portion 32 into which stirring bar 34 including magnet 36 and tetrafluoroethylene fluorocarbon resin (Teflon) coating 38 is inserted. Tube 28 is inserted into the end of enlarged portion 32 of chamber 26, thus restricting the space available for bar 34 to move longitudinally and providing means for transporting the mixed fluids from chamber 26 to point of observation 30. Magnetic stirrer 40 comprised of permanent bar magnet 42 and motor 44 encased in housing 46 provides the means to activate stirring bar 34. When activated, bar 34 attempts to assume the same end-over-end rotation about a vertical axis of the driving magnet; however, it is prevented from doing so by the built-in special restraints of chamber 26. As the driving magnet 42 rotates about a vertical axis, both the horizontal and vertical components of the magnetic force field, at points not on the vertical axis, change continually. When the driven magnetic bar 34 is located off of the axis of rotation of the driving magnet, these changing forces cause driven magnetic bar 34 to precess about an average magnetic axis coincident with the axis of chamber 26. Consequently, the combination of the forces acting upon driven magnetic bar 34 and the restraining spacial limitations cause bar 34 to yaw, pitch and roll and, in so doing, to thoroughly mix the confluent fluid as it flows through chamber 26.

We claim:

1. A method of thoroughly mixing the continuously flowing confluent fluid from multiple low velocity streams of individual solutions comprising passing the flowing confluent fluid through a tubular shaped chamber having enclosed therein a movable means for agitating and mixing the fluids, said movable means, when activated, being subjected to forces tending to rotate said means around an axis perpendicular to its longitudinal axis and said means having longitudinal and diametrical space limitations in said chamber so as to be restriced in its movement, and activating said movable means thereby causing said means to yaw, pitch, and roll.

2. A method of thoroughly mixing the continuously flowing confluent fluid from multiple low velocity streams of individual solutions comprising passing the flowing confluent fluid through a tubular shaped chamber having enclosed therein a movable means for agitating and mixing the fluids, said movable means, when in a resting state, having a spacial orientation in the chamber such that its longitudinal axis is generally aligned with the longitudinal axis of said chamber, and said movable means having longitudinal and diametrical space limitations in the chamber so that when said means is activated its spacial orientation in said chamber remains in the same general direction as when said movable means is in a resting state, and activating said movable means thereby causing said means to precess about an average axis coincident with the axis of the tubular shaped chamber.

3. A method of thoroughly mixing the continuously flowing confluent fluid from multiple low velocity streams of individual solutions comprising passing the flowing confluent fluid through a tubular shaped chamber which encloses a bar magnet having its north pole at one longitudinal end and its south pole at the other end for agitating and mixing the fluids, said enclosed magnet having both longitudinal and diametrical space limitations in said chamber so as to be restricted in its movement, and activating said magnet with a rotating bar magnet thus causing said enclosed magnet to yaw, pitch, and roll.

4. The method of claim 3 in which an efficiency of mixing higher than 99.5% is provided.

5. The method of claim 4 in which the flow rate of the fluid is about from 0.02 cm./sec. to about 1.31 cm./sec.

6. The method of claim 3 in which the enclosed magnet is tetrafluoroethylene fluorocarbon resin (Teflon) coated.

7. The method of claim 6 in which the longitudinal axis of the enclosed magnet when said magnet is not in motion is generally aligned with the longitudinal axis of the tubular shaped chamber.

8. In an apparatus for thoroughly mixing multiple streams of individual solutions having means for joining the streams and for providing a continuous flow of the confluent fluid to and from a mixing chamber, said chamber having inlet and outlet ports, means of controlling the flow rate of the fluid and means for observing the mixed fluid, wherein the improvement comprises a tubular shaped mixing chamber having one end constricted, a movable means enclosed within said chamber for agitating and mixing fluids, said means being restricted in movement by space limitations to yawing, pitching, and rolling, and means for activating said movable means.

9. In an apparatus for thoroughly mixing multiple streams of individual solutions having means for joining the streams and for providing a continuous flow of the confluent fluid to and from a mixing chamber, said chamber having inlet and outlet ports, means of controlling the flow rate of the fluid and means for observing the mixed fluid, wherein the improvement comprises a tubular shaped mixing chamber having one end constricted, a bar magnet having, when in a resting state, a spacial orientation in said chamber such that its longitudinal axis is generally aligned with the longitudinal axis of the chamber, said bar magnet having its north pole at one longitudinal end and its south pole at the other longitudinal end, said bar magnet enclosed within said chamber for agitating and mixing fluid and being restricted in movement by spacial limitations within said chamber so that when the bar magnet is activated the north and south poles of said bar magnet remain in the same spacial orientation as in the resting state, and means for activating said bar magnet.

10. In an apparatus for thoroughly mixing multiple streams of individual solutions having means for joining the streams and for providing a continuous flow of the confluent fluid to and from a mixing chamber, said chamber having inlet and outlet ports, means of controlling the flow rate of the fluid and means for observing the mixed fluid, wherein the improvement comprises a tubular shaped mixing chamber having one end constricted, a bar magnet having its north pole at one longitudinal end and its south pole at the other end, said magnet enclosed within said chamber for agitating and mixing fluid and being restricted in moving by space limitations within said chamber to yawing, pitching, and rolling; and means for activating said movable means.

11. The improvement of claim 10 wherein the magnet is coated.

12. The improvement of claim 10 wherein the means for activating the movable means is a magnetic stirrer.

13. The improvement of claim 10 which provides an efficiency of mixing greater than 99.5% at fluid flow rates of from about 0.02 cm./sec. to about 1.3 cm./sec.

14. The improvement of claim 10 wherein the magnet is restricted in movement by providing an internal diameter of said chamber which is less than the length of said magnet and a longitudinal length of said chamber which is about 1.5 times the length of said magnet.

* * * * *